US008872714B2

(12) United States Patent
Hozouri

(10) Patent No.: US 8,872,714 B2
(45) Date of Patent: Oct. 28, 2014

(54) WIDE BEAM ANTENNA

(75) Inventor: Behzad Tavassoli Hozouri, Sunnyvale, CA (US)

(73) Assignee: Space Systems/Loral, LLC, Palo Alto, CA (US)

( * ) Notice: Subject to any disclaimer, the term of this patent is extended or adjusted under 35 U.S.C. 154(b) by 236 days.

(21) Appl. No.: 13/474,084

(22) Filed: May 17, 2012

(65) Prior Publication Data

US 2013/0307741 A1 Nov. 21, 2013

(51) Int. Cl.
*H01Q 13/06* (2006.01)
*H01Q 13/00* (2006.01)

(52) U.S. Cl.
CPC ..... *H01Q 13/06* (2013.01); *H01Q 13/00* (2013.01)
USPC ..... 343/781 R; 343/772

(58) Field of Classification Search
CPC ..... H01Q 13/00; H01Q 13/06
USPC ..... 343/772, 779, 781 R, 786
See application file for complete search history.

(56) References Cited

U.S. PATENT DOCUMENTS

| | | | | |
|---|---|---|---|---|
| 3,434,146 | A | 3/1969 | Petrich et al. | |
| 3,795,002 | A | 2/1974 | Nemit | |
| 3,831,176 | A | 8/1974 | Epis et al. | |
| 4,380,014 | A | 4/1983 | Howard | |
| 4,578,681 | A | 3/1986 | Howard | |
| 4,636,798 | A | 1/1987 | Seavey | |
| RE32,485 | E | 8/1987 | Yang et al. | |
| 4,885,593 | A | 12/1989 | Hess, Jr. et al. | |
| 4,958,162 | A | 9/1990 | Roberts et al. | |
| 5,121,129 | A | 6/1992 | Lee et al. | |
| 5,200,757 | A | 4/1993 | Jairam | |
| 5,248,987 | A | 9/1993 | Lee | |
| 5,596,338 | A | 1/1997 | Smith | |
| 5,859,615 | A | 1/1999 | Toland et al. | |
| 6,480,164 | B2 | 11/2002 | Posner et al. | |
| 7,642,979 | B2 * | 1/2010 | Hook et al. | 343/767 |
| 7,688,268 | B1 | 3/2010 | West et al. | |
| 7,969,376 | B2 * | 6/2011 | Steghafner et al. | 343/786 |
| 2002/0113746 | A1 | 8/2002 | Strickland | |
| 2003/0210197 | A1 | 11/2003 | Cencich et al. | |
| 2009/0079649 | A1 | 3/2009 | Steghafner et al. | |

FOREIGN PATENT DOCUMENTS

| | | |
|---|---|---|
| WO | WO 2006/019339 | 2/2006 |

OTHER PUBLICATIONS

Lee (1994) "A Low Cross-polarization Circularly Polarized Spacecraft TC&R Antenna," *IEEE*, pp. 914-917.
Dyson (1965) "The Characteristics and Design of the Conical Log-Spiral Antenna," *IEEE*, pp. 488-499.

(Continued)

*Primary Examiner* — Hoang V Nguyen
(74) *Attorney, Agent, or Firm* — Weaver Austin Villeneuve & Sampson LLP

(57) ABSTRACT

A wide beam radio frequency (RF) antenna includes a waveguide and one or more electrically conductive protrusions. The waveguide has at least one electrically conductive interior wall surface, a boresight defined by a longitudinal axis, and an aperture plane, transverse to the longitudinal axis, disposed at a distal end of the waveguide. A first proximal portion of each protrusion is electrically coupled to the electrically conductive interior wall surface, a distal portion of the protrusion being outside the aperture plane.

20 Claims, 10 Drawing Sheets

(56) References Cited

OTHER PUBLICATIONS

Galindo, et al., (Nov. 1965) "A Near-Isotropic Circulary Polarized Antenna for Space Vehicles", *IEEE Transactions on Antennas and Propagation*, vol. AP-13 No. 6, pp. 872-877.

International Search Report dated Mar. 8, 2013 in PCT/US2012/068688.

Oliver, A.D. et al., "Microwave Horns and Feeds", Microwave Horns and Feeds, XP002077260, Jan. 1, 1994, pp. 287-288.

* cited by examiner

WIDE BEAM ANTENNA

TECHNICAL FIELD

This disclosure relates to a radio frequency (RF) antenna, and, more particularly, to a wide beam RF antenna.

BACKGROUND OF THE INVENTION

Widebeam antennas are used extensively in military and commercial space, aviation and ground applications. Examples of applications of such an antenna include telemetry command and ranging (TC&R) antennas for spacecraft, airborne ground surveillance radar systems or user terminal antennas for global positioning satellite (GPS) receivers. A wideband antenna may also be used as a feed for certain types of reflectors. For example, in compact range applications, in order to minimize amplitude taper and increase a cross-sectional area of a quiet zone volume, a widebeam feed may be desirable. In addition, a widebeam antenna feed may be used in cooperation with a deep reflector antenna having an F/D ratio of about one or less. Desirably, such antennas exhibit quasi-omnidirectional (sometimes referred to as near-isotropic) coverage patterns. Using conventional techniques, however, antennas capable of exhibiting such coverage patterns have been unduly bulky, complex, expensive, and/or difficult to fabricate, tune or maintain or exhibit excessive return loss, particularly where the antenna is required to handle a broad band RF signal, circularly polarized electromagnetic radiation, and/or to exhibit low cross polarization over almost all directions. Conventional techniques also frequently rely on dielectric components, such components being disadvantageous for, at least, spacecraft applications.

Accordingly, an improved widebeam antenna is desirable.

SUMMARY OF INVENTION

The present inventor has appreciated that a wide beam RF antenna, exhibiting a quasi-omnidirectional coverage pattern may include a waveguide and one or more electrically conductive protrusions. The waveguide includes at least one electrically conductive interior wall surface, and has a boresight defined by a longitudinal axis. The waveguide has an aperture plane transverse to the longitudinal axis and disposed at a distal end of the waveguide and may be configured for one or both of radiating RF energy and receiving RF energy. The electrically conductive protrusions have a proximate portion electrically coupled to the electrically conductive interior wall surface, and a distal portion of the protrusion disposed outside the aperture plane.

In an embodiment, the one or more protrusions may be configured to at least partially extend one or both of internal electromagnetic currents and internal electromagnetic fields of the RF antenna in a direction toward the proximal end of the waveguide.

In another embodiment, an outermost edge of the distal portion may extend radially outward beyond an exterior surface of the wave guide. At least one of the one or more protrusions may include a second proximal portion that extends axially, outside an exterior surface of the wave guide, from the distal portion toward the proximal end of the waveguide.

In some embodiments, the RF energy may be linearly, circularly, or elliptically polarized.

In a yet further embodiment, the waveguide may include electrically conductive ridges. At least one of the one or more protrusions may be coupled with at least one of the electrically conductive ridges.

In some embodiments, the one or more protrusions may include at least three or at least eight protrusions symmetrically distributed with respect to the boresight.

In an embodiment, the waveguide is hollow.

In a further embodiment, an antenna system may include a reflector, a feed, illuminating the reflector. The feed may include a waveguide, the waveguide including at least one electrically conductive interior wall surface, and having a boresight defined by a longitudinal axis, the waveguide having an aperture plane transverse to the longitudinal axis and disposed at a distal end of the waveguide, the waveguide configured for one or both of radiating RF energy and receiving RF energy. The waveguide may include one or more electrically conductive protrusions, a first proximal portion of the protrusion electrically coupled to the electrically conductive interior wall surface, a distal portion of the protrusion being outside the aperture plane.

BRIEF DESCRIPTION OF THE DRAWINGS

The included drawings are for illustrative purposes and serve only to provide examples of possible structures for the disclosed inventive filters and multiplexers. These drawings in no way limit any changes in form and detail that may be made by one skilled in the art without departing from the spirit and scope of the disclosed embodiments.

Figure 1:
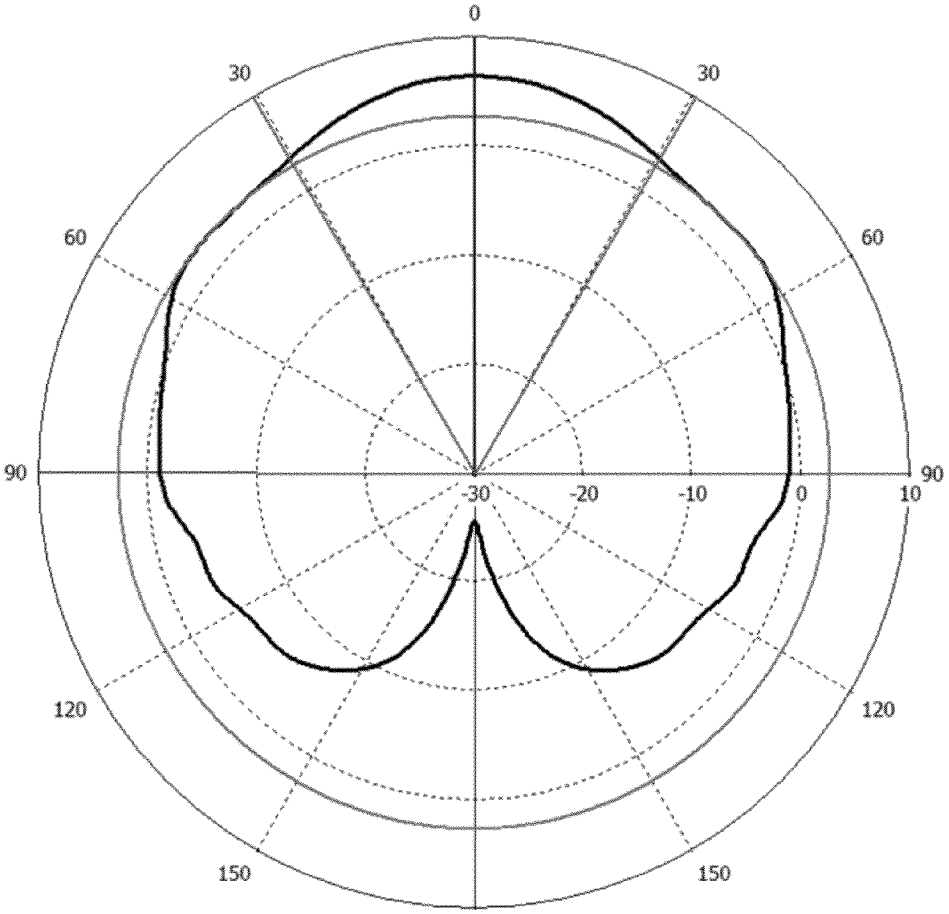
FIG. 1 shows an example of a quasi-omnidirectional coverage.

Throughout the drawings, the same reference numerals and characters, unless otherwise stated, are used to denote like features, elements, components, or portions of the illustrated embodiments. Moreover, while the subject invention will now be described in detail with reference to the drawings, the description is done in connection with the illustrative embodiments. It is intended that changes and modifications can be made to the described embodiments without departing from the true scope and spirit of the disclosed subject matter, as defined by the appended claims.

DETAILED DESCRIPTION

Specific exemplary embodiments of the invention will now be described with reference to the accompanying drawings. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

It will be understood that when an element is referred to as being "connected" or "coupled" to another element, it can be directly connected or coupled to the other element, or intervening elements may be present. Furthermore, "connected" or "coupled" as used herein may include wirelessly connected or coupled. It will be understood that although the terms "first" and "second" are used herein to describe various elements, these elements should not be limited by these terms. These terms are used only to distinguish one element from another element. Thus, for example, a first user terminal could be termed a second user terminal, and similarly, a second user terminal may be termed a first user terminal without departing from the teachings of the present invention. As used herein, the term "and/or" includes any and all combinations of one or more of the associated listed items. The symbol "/" is also used as a shorthand notation for "and/or".

The terms "spacecraft", "satellite" and "vehicle" may be used interchangeably herein, and generally refer to any orbiting satellite or spacecraft system.

The present inventor has appreciated that a wide beam RF antenna, i.e., an RF antenna exhibiting a near-isotropic or quasi-omnidirectional coverage pattern, may be achieved, with a waveguide design that is compact (low profile) and simple to fabricate. Advantageously, the waveguide may be hollow and/or avoid use of dielectric components. In an embodiment, a wide beam RF antenna designed in accordance with the present teachings may be configured to handle a broad band RF signal, circularly polarized electromagnetic radiation, and may exhibit low cross polarization over almost all directions.

Referring now to FIG. 1, an example of a quasi-omnidirectional coverage pattern is illustrated. The illustrated pattern exhibits a typical cardioid shape with maximal signal strength along the boresight, at 0 degrees, and minimal signal strength at 180 degrees. Desirably, signal strength at +/−90 degrees from the boresight is less than 1 db down from a reference signal strength of a hypothetical perfectly isotropic antenna, and signal strength at +/−150 degrees is less than 9 dB down from the reference signal strength.

Figure 2A:
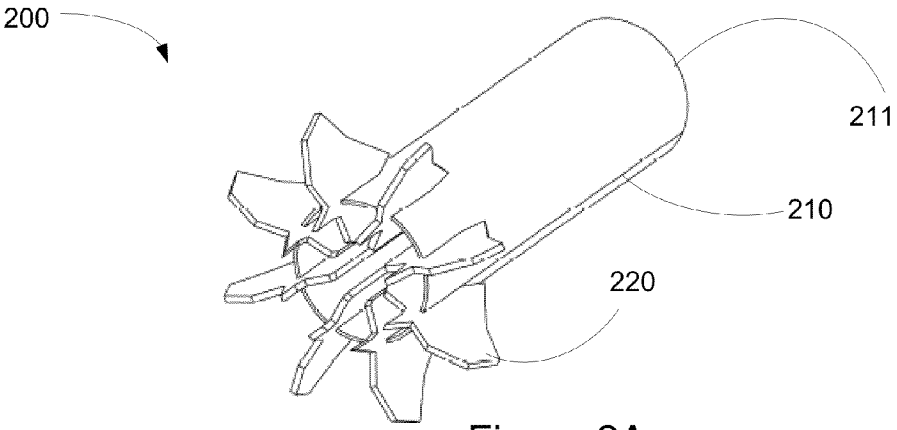
FIGS. 2A-2C show an example of a wide beam RF antenna in accordance with an embodiment.
Figure 2B:
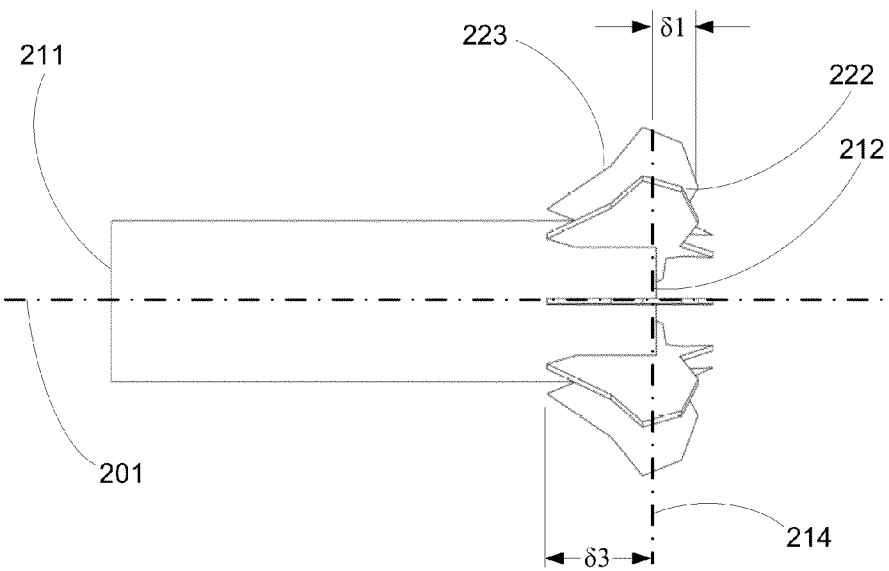
Figure 2C:
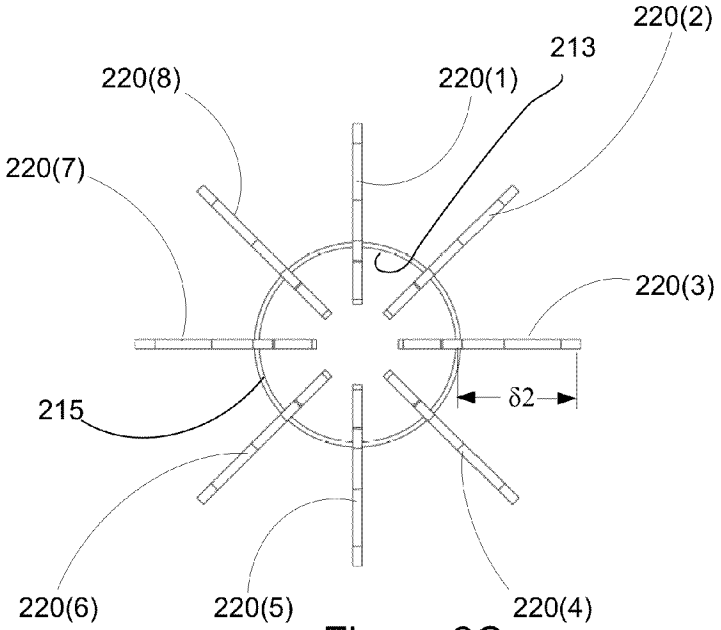

Referring now to FIGS. 2A-2C, an example is illustrated of a wide beam RF antenna, operable to provide a coverage pattern substantially conforming to the coverage pattern illustrated in FIG. 1. FIGS. 2A, 2B, and 2C depict views of RF antenna 200 that may be referred to, for convenience, respectively as a perspective view, a side view and an end view. In the illustrated implementation, RF antenna 200 includes waveguide 210 and a plurality of electrically conductive protrusions 220 that are electrically coupled, directly or indirectly, with an electrically conductive interior wall 213.

Waveguide 210 has a proximal end 211, which may ordinarily be coupled, directly or indirectly, to, for example, a transceiver (not illustrated). Waveguide 210 has a distal end 212 defined by an aperture plane 214 that may be, as illustrated, transverse to longitudinal axis (boresight) 201. RF energy may be radiated from and/or received by waveguide 210 across aperture plane 214.

In some embodiments, protrusions 220 may be configured to at least partially extend internal electromagnetic currents and/or fields of RF antenna 200 radially outward with respect to boresight 201, or, advantageously, radially outward and toward the proximal end 211 of waveguide 210. As a result, RF energy may be more effectively radiated at angles significantly away from boresight 201, for example, at angles 90-150 degrees from boresight 201. For example, distal portion 222 of protrusion 220 may be disposed such that distal portion 222 extends past (or "outside") aperture plane 214. In the illustrated embodiment, for example, distal portion 222 of each protrusion 220 extends a distance δ1 outside aperture plane 214.

In some embodiments, some of distal portion 222 may also extend radially outward, toward or beyond an exterior surface of wall 215. In the illustrated embodiment, for example, an outermost edge of distal portion 222 extends radially a distance δ2 beyond an exterior surface of wall 215.

In some embodiments, second proximal portion 223 of protrusion 220 may be disposed such that second proximal portion 223 extends some distance toward the proximal end 211 of waveguide 210. In the illustrated embodiment, for example, the second proximal portion 223 of each protrusion is disposed such that a proximal edge of second proximal portion 223 extends axially a distance δ3 from aperture plane 214 toward proximal end 211.

It will be appreciated that FIG. 2 illustrates a particular example arrangement of protrusions, and that the number of protrusions, and the respective geometry of the protrusions may vary substantially from the illustrated example. In the illustrated embodiment, for example, RF antenna 200 is illustrated as including eight protrusions 220, but this is not necessarily so. A greater or smaller number of protrusions (for example, three protrusions, four to seven protrusions, or nine or more protrusions) is within the contemplation of the present disclosure. Moreover, the protrusions may not be planar, or of the particular shapes illustrated. It will be appreciated that the location and geometric features of protrusions 220 may be optimized through experiment or electromagnetic modeling.

Figure 3:
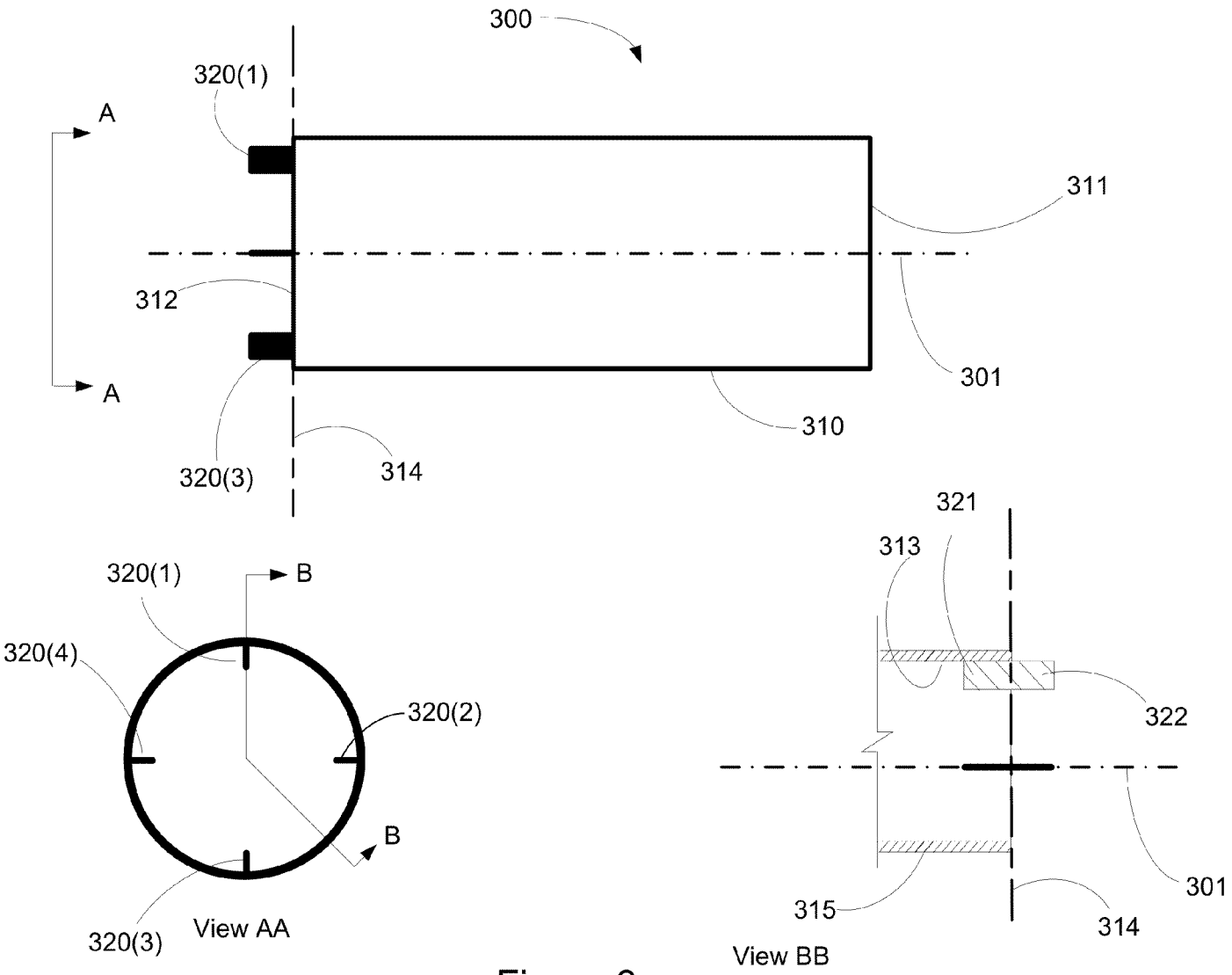
FIG. 3 shows an example of a wide beam RF antenna in accordance with an embodiment.

Referring now to FIG. 3, a further embodiment will be described. RF antenna 300 may include waveguide 310 and a plurality of protrusions 320. An interior volume of waveguide 310 may be hollow and may be defined by one or more walls 315. Wall 315 may be of made of metal or another electrically conductive material. At least one wall may be configured to have an electrically conductive interior surface 313. In the illustrated example, wall 315 has circular cross section, but this is not necessarily the case. A waveguide with a square, hexagonal, or other geometric cross section is within the contemplation of the present inventor, in which case a plurality of planar walls may define the interior volume of waveguide 310. A waveguide with an elliptical or other asymmetric cross section is also within the contemplation of the present disclosure. As will be described herein below, the electrically conductive interior surface 313, in some implementations, may also include ridges (not illustrated).

Waveguide 310 has a proximal end 311, which may ordinarily be coupled, directly or indirectly, to, for example, a transceiver (not illustrated). Waveguide 310 has a distal end 312 defined by an aperture plane 314 that may be, as illustrated, transverse to longitudinal axis (boresight) 301. RF energy may be radiated from and/or received by waveguide 310 across aperture plane 314.

Each protrusion 320 may be electrically conductive. Advantageously, a first proximal portion 321 of each protrusion 320 may be electrically coupled, either directly or indirectly, to electrically conductive interior wall surface 313 of waveguide 310. Protrusions 320 may be configured so as to at least partially extend internal electromagnetic currents and/or fields of RF antenna 300 radially outward with respect to boresight 301, or, advantageously, radially outward and toward the proximal end 311 of waveguide 310. For example, in the illustrated embodiment, distal portion 322 of protrusion 320 is disposed such that distal portion 322 extends in an axial direction outside aperture plane 314. As a result, RF energy may be more effectively radiated at angles significantly away from boresight 301, for example, at angles 90-150 degrees from boresight 301.

In the illustrated embodiment, RF antenna 300 includes four protrusions 320, but a greater or smaller number of protrusions is within the contemplation of the present inventor.

Figure 4:
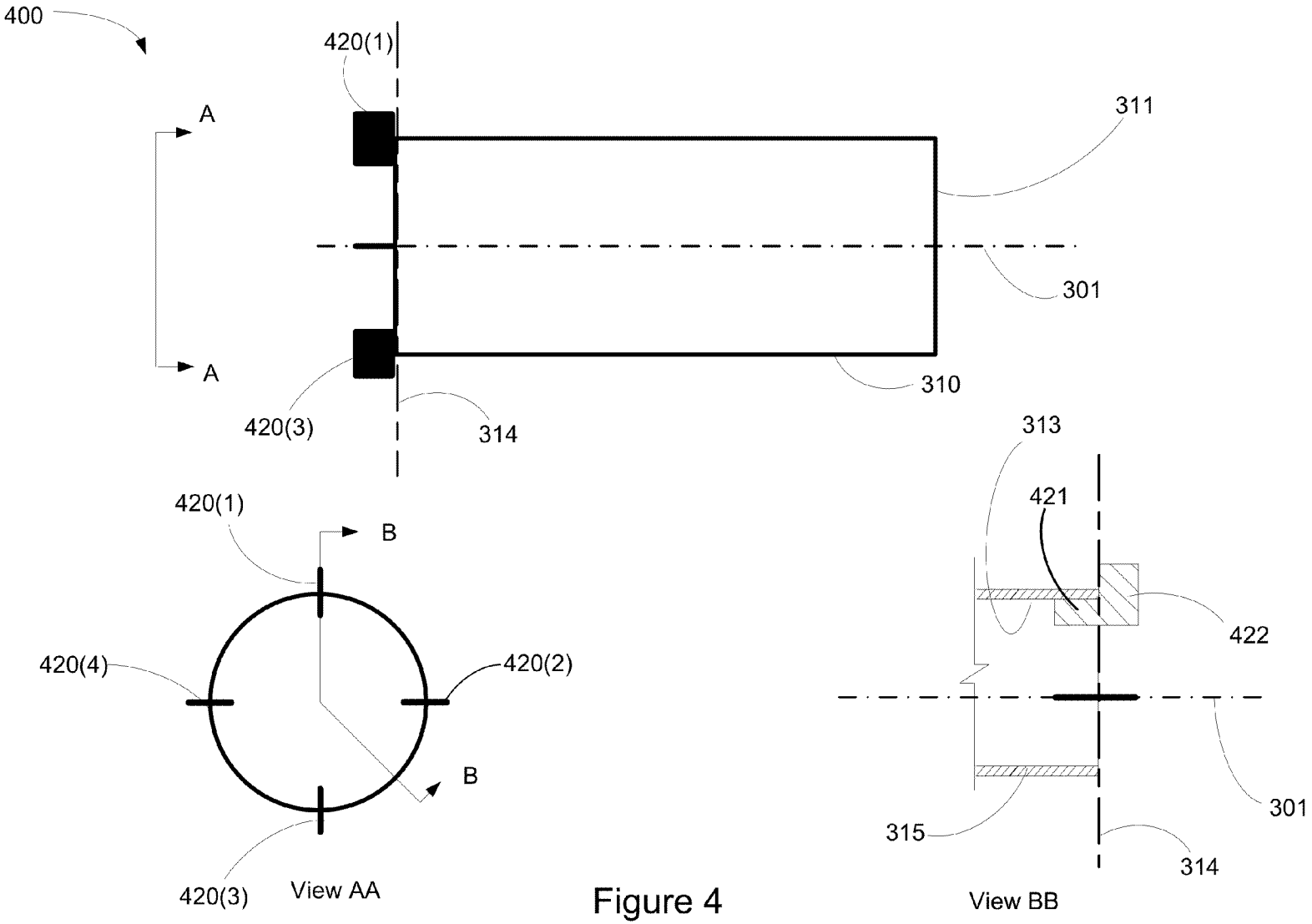
FIG. 4 shows an example of a wide beam RF antenna in accordance with an embodiment.

Referring now to FIG. 4, another example is illustrated of a wide beam RF antenna. In the illustrated embodiment, RF antenna 400 includes waveguide 310 and a plurality of protrusions 420.

Each protrusion 420 may be electrically conductive. Advantageously, a first proximal portion 421 of each protrusion 420 may be electrically coupled, directly or indirectly, with electrically conductive interior wall surface 313 of waveguide 310. Protrusions 420 may be configured to at least partially extend internal electromagnetic currents and/or fields of RF antenna 400 radially outward with respect to boresight 301, or, advantageously, radially outward and toward the proximal end 311 of waveguide 310. For example, in the illustrated embodiment, distal portion 422 of protrusion 420 is disposed such that distal portion 422 extends outside aperture plane 314 and such that some of distal portion 422 extends radially outward, beyond an exterior surface of wall 315. As a result, RF energy may be more effectively radiated at angles from boresight 301 ranging, for example, from 90 to 150 degrees.

Figure 5:
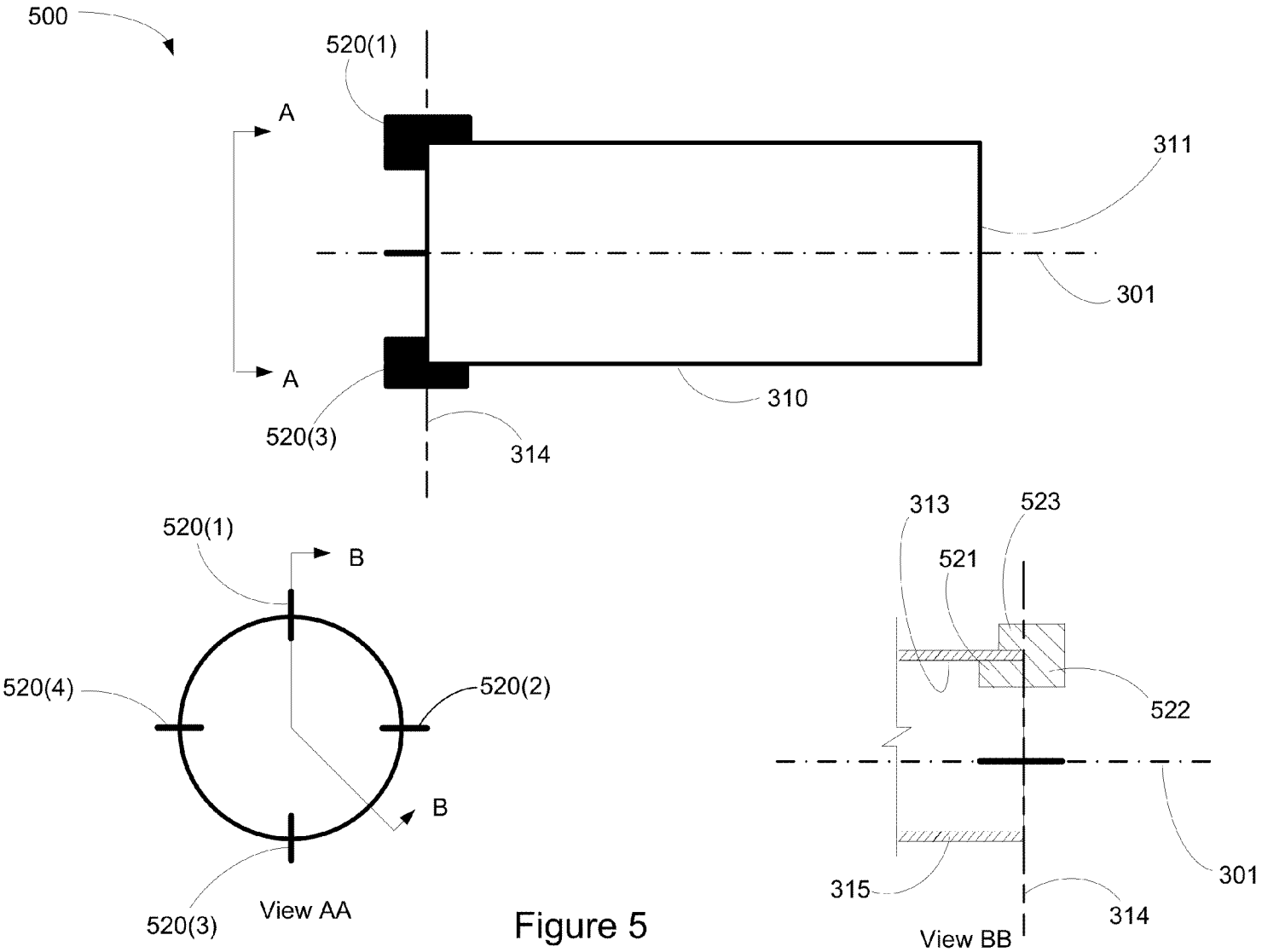
FIG. 5 shows an example of a wide beam RF antenna in accordance with an embodiment.

Referring now to FIG. 5, another example is illustrated of a wide beam RF antenna. In the illustrated embodiment, RF antenna 500 includes waveguide 310 and a plurality of protrusions 520.

Each protrusion 520 may be electrically conductive. Advantageously, a first proximal portion 521 of each protrusion 520 may be electrically coupled, directly or indirectly, with electrically conductive interior wall surface 313 of waveguide 310. Protrusions 520 may be configured to at least partially extend internal electromagnetic currents and/or fields of RF antenna 500 radially outward with respect to boresight 301, or, advantageously, radially outward and toward the proximal end 311 of waveguide 310. For example in the illustrated embodiment, distal portion 522 of protrusion 520 is disposed such that distal portion 522 extends outside aperture plane 314. Moreover, some of distal portion 522 extends radially outward, beyond an exterior surface of wall 315, and a second proximal portion 523 of protrusion 520 is disposed such that second proximal portion 523 extends some distance toward the proximal end 311 of waveguide 310. As a result, RF energy may be more effectively radiated at angles from boresight 301 ranging, for example, from 90 to 150 degrees.

In the above-illustrated embodiments, waveguide 310 is illustrated as having a straight cylindrical form factor. It will be appreciated, however, that the foregoing teachings are applicable to waveguides having tapered or stepped transition regions. Moreover, a waveguide having a non-circular cross-section is within the contemplation of the present inventor.

Figure 6:
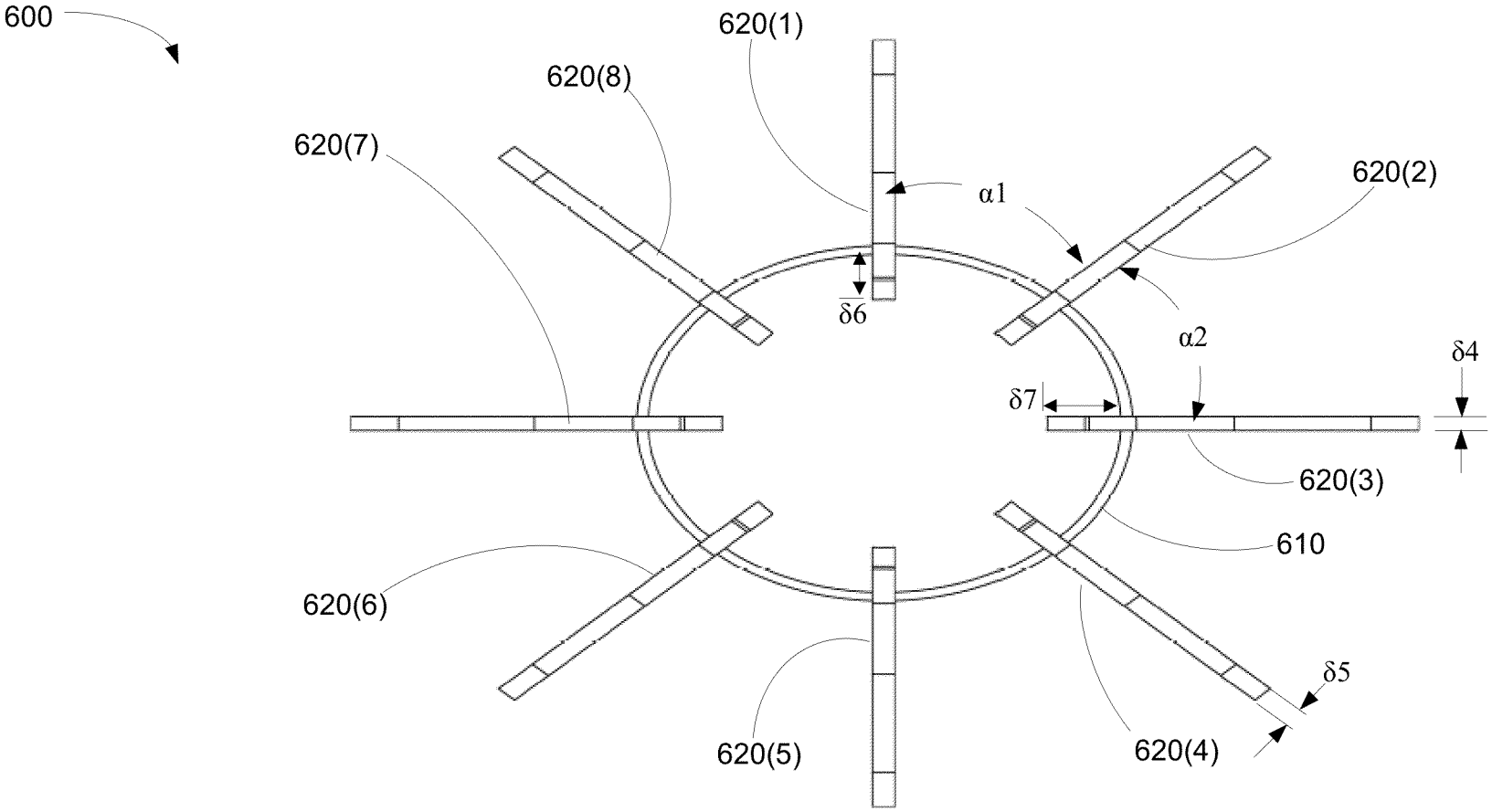
FIG. 6 shows an example of a wide beam RF antenna in accordance with an embodiment.

In applications where an asymmetrical beam pattern is desirable, the above teachings may be applied, for example, to a waveguide having an elliptical cross section. In addition, or alternatively, ridges and/or protrusions may be provided that are not identical and/or are distributed non-symmetrically. Referring now to FIG. 6, for example, an end view of an RF antenna 600 that includes elliptical waveguide 610 is illustrated. In the illustrated embodiment, an angular separational between protrusion 620(1) and 620(2), is different, for example, than an angular separation $\alpha 2$ between protrusion 620(2) and 620(3), Moreover, in the illustrated embodiment, a thickness $\delta 4$ of protrusion 620(3) is different than, for example, thickness $\delta 5$ of protrusion 620(4), and depth $\delta 6$ of protrusion 620(1) is different than, for example, depth $\delta 7$ of protrusion 620(3).

In some embodiments, a ridged (or "ridge loaded") waveguide may be contemplated. The ridges may reduce the size of the waveguide operable to work at the same frequency compared to a non-ridge loaded waveguide. The main waveguide dimension(s), the number of ridges and their dimensions, and the shape and dimensions of the ridge extensions/protrusions can be optimized to achieve good directivity and low cross polarization over very wide angles, while having reasonably low return loss. For example, in some implementations, the present inventor has found that directivity of better than −4 dBi for angles up to 110 degrees from boresight can be achieved, with axial ratio better than 4 dB over the same angular range, and return loss of better than 25 dB over about 8% of relative bandwidth.

Figure 7:
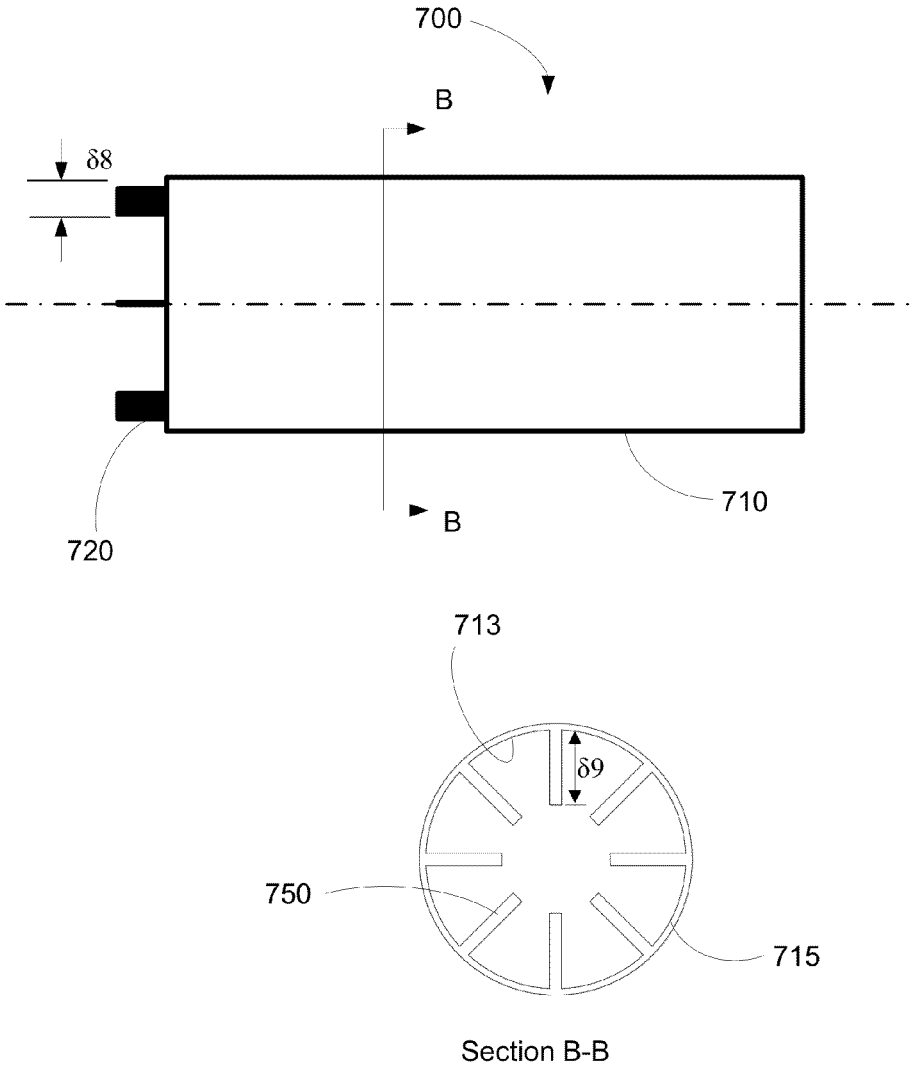
FIG. 7 shows an example of wide beam RF antenna, including a ridge loaded waveguide, in accordance with an embodiment.

Referring now to FIG. 7, an embodiment of a ridge loaded waveguide is illustrated. RF antenna 700 may include waveguide 710 and a plurality of protrusions 720. An interior volume of waveguide 710 may be hollow and may be defined by one or more walls 715. Wall 715 may be of made of metal or another electrically conductive material. At least one wall may be configured to have an electrically conductive interior surface 713. In the illustrated example, wall 715 has a circular cross section, but this is not necessarily the case. A number of ridges 750 may extend inward, substantially radially, from interior wall surface 715. It will be appreciated that ridges 750 may be an integral feature of wall 715, or may be connected to wall 715 by brazing, welding or mechanical means. Advantageously, ridges 750 are electrically conductive and are electrically coupled with wall 715.

In some embodiments, one or more protrusions 720 may be electrically coupled, directly or indirectly, with a respective ridge 750. In some embodiments, each protrusion 720 is an extension of a respective ridge 750. In such embodiments, each protrusion 720 and respective ridge 750 may form an integral component. Whether or not protrusion 720 and respective ridge 750 form an integral component, dimensions $\delta 8$ and $\delta 9$ may or may not be substantially similar.

Figure 8:
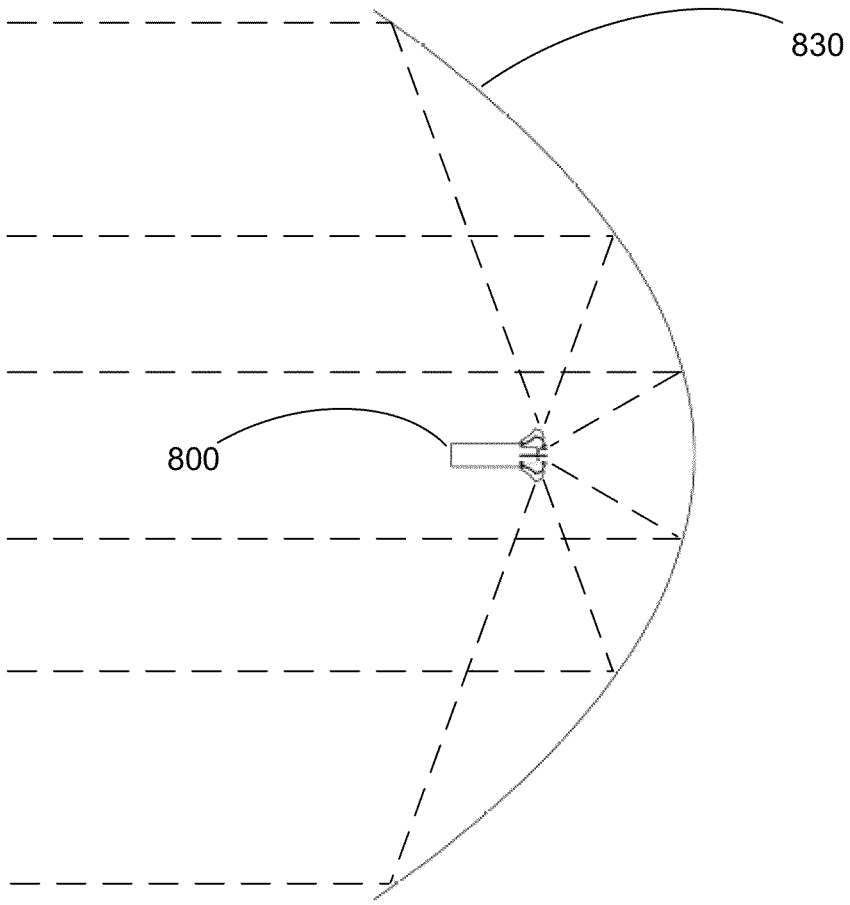
FIG. 8 shows an example of an antenna system using a wide beam RF antenna as a feed in accordance with an embodiment.

A widebeam feed may be implemented in cooperation with a deep reflector antenna having an F/D ratio, for example, of about one or less. For example, referring now to FIG. 8, RF antenna 800, configured with protrusions in accordance with the present teachings, may be used as a feed for a suitably shaped reflector. In the illustrated embodiment, for example, wave guide antenna 800 illuminates parabolic reflector 830.

A benefit of the presently disclosed techniques is that a quasi-omnidirectional coverage pattern may be achieved by configuring a conventional waveguide antenna with conductive protrusions that add only modestly to the volume and mass of the conventional waveguide antenna. For example, the present inventor has found that, in some embodiments, the protrusions result in increasing the length of the wave guide antenna by less than 35% of the waveguide diameter, while still substantially increasing the waveguide antenna's beamwidth. In implementations where the protrusions extend radially, a radial extension of less than about 60% of the waveguide diameter has been found to be sufficient to significantly improve the waveguide antenna's beamwidth. Furthermore, the protrusions provide the above-mentioned benefits, while being mechanically simple to implement and requiring little or no "tuning".

Figure 9:
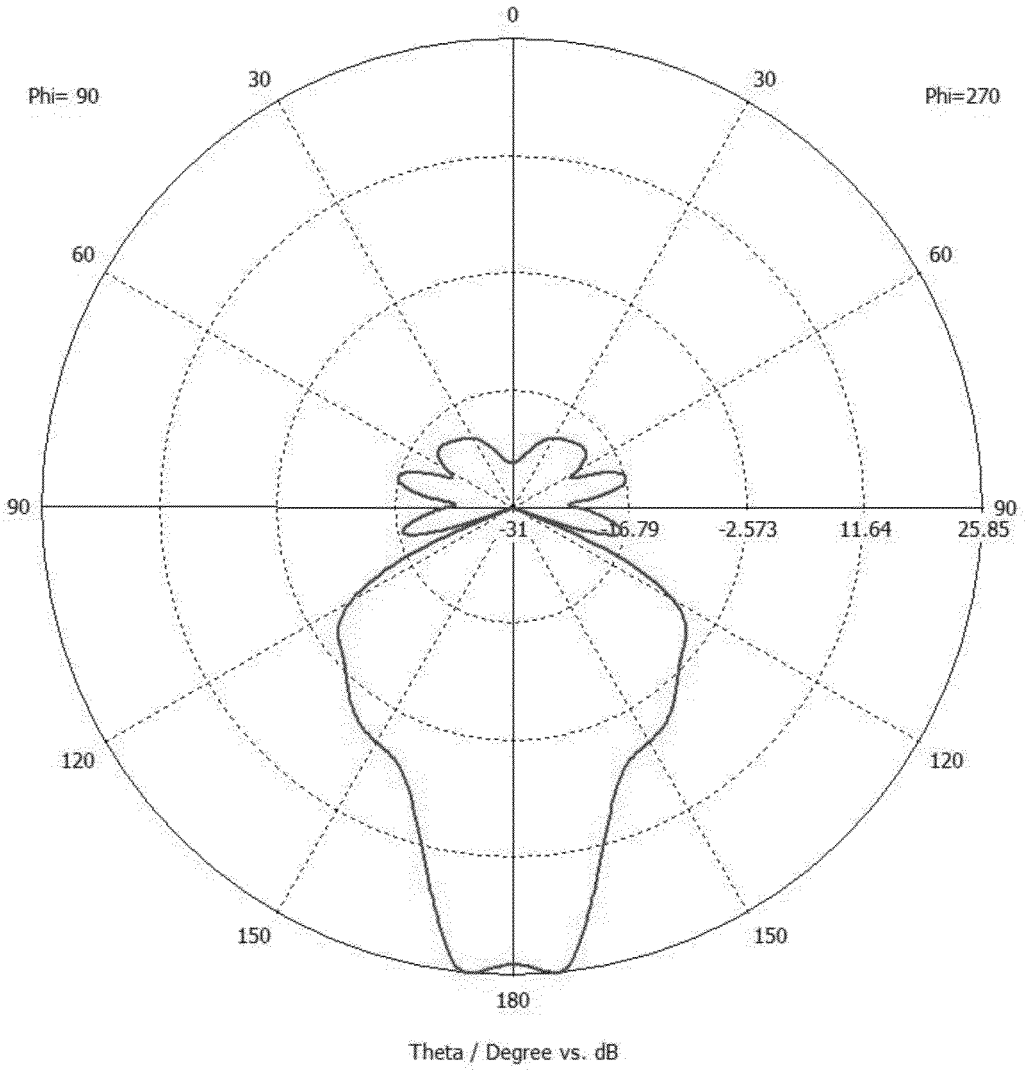
FIG. 9 shows an example of cross polarization performance of a wide beam antenna in accordance with an embodiment.

A further benefit of the presently disclosed techniques is low cross polarization over a substantial range of angles. For example, referring now to FIG. 9, it may be seen that from 0 to 115 degrees from antenna the boresight, cross polarization is less than −16 dB relative to the main polarization. It will be appreciated that the type of radiation polarization depends on the waveguide antenna port modal excitation. For example, when the waveguide antenna is connected to an appropriate waveguide polarizer, the waveguide antenna may radiate and receive circularly polarized radiation with low axial ratio throughout a substantial range of angles from the boresight. Similarly, if excited by only one dominant mode, the waveguide antenna may radiate and receive linearly polarized radiation with high axial ratio throughout a substantial range of angles from the boresight.

Figure 10:
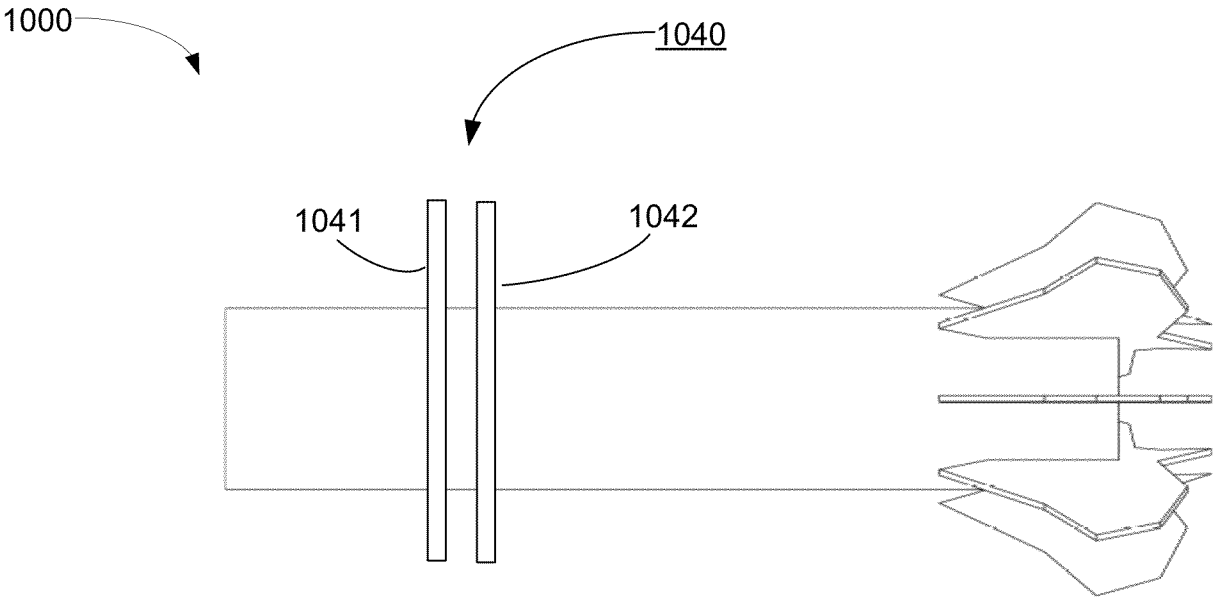
FIG. 10 shows an example of a wide beam RF antenna in accordance with an embodiment.

In some embodiments, a waveguide antenna according to the present teachings may be configured with one or more chokes. For example, referring now to FIG. 10, radial choke 1040 may be configured as an external feature of waveguide antenna 1000. In the illustrated implementation, radial choke 1040 includes two radial walls 1041 and 1043. It will be appreciated that the location and geometric features of choke 1040 may be varied, and may be optimized for particular applications through experiment and/or electromagnetic modeling. For example, a choke arrangement that includes multiple separate or side-by-side chokes may be used for increasing a bandwidth over which the choke arrangement operates.

Thus, a wide beam RF antenna has been described. While various embodiments have been described herein, it should be understood that they have been presented by way of example only, and not limitation. It will thus be appreciated that those skilled in the art will be able to devise numerous systems and methods which, although not explicitly shown or described herein, embody said principles of the invention and are thus within the spirit and scope of the invention as defined by the following claims.

What is claimed is:

1. A wide beam radio frequency (RF) antenna, the RF antenna comprising:

a waveguide, comprising at least one electrically conductive interior wall surface, and having a boresight defined by a longitudinal axis, the waveguide having an aperture plane transverse to the longitudinal axis and disposed at a distal end of the waveguide, the waveguide configured for one or both of radiating RF energy and receiving RF energy; and one or more electrically conductive protrusions, a first proximal portion of the protrusion electrically coupled to the electrically conductive interior wall surface, a distal portion of the protrusion being outside the aperture plane; wherein:

the RF antenna is configured to exhibit a quasi-omnidirectional coverage pattern.

2. The RF antenna of claim 1, wherein the one or more protrusions are configured to at least partially extend one or both of internal electromagnetic currents and internal electromagnetic fields of the RF antenna in a direction toward the proximal end of the waveguide.

3. The RF antenna of claim 1, wherein an outermost edge of the distal portion extends radially outward beyond an exterior surface of the wave guide.

4. The RF antenna of claim 3, wherein at least one of the one or more protrusions includes a second proximal portion that extends axially, outside an exterior surface of the wave guide, from the distal portion toward the proximal end of the waveguide.

5. The RF antenna of claim 1, wherein the RF energy is linearly polarized.

6. The RF antenna of claim 1, wherein the RF energy is elliptically polarized.

7. The RF antenna of claim 1, wherein the RF energy is circularly polarized.

8. The RF antenna of claim 1, wherein the waveguide has a circular cross section.

9. The RF antenna of claim 1, wherein the waveguide includes electrically conductive ridges.

10. The RF antenna of claim 9, wherein at least one of the one or more protrusions is coupled with at least one of the electrically conductive ridges.

11. The RF antenna of claim 1, wherein the one or more protrusions comprise at least three protrusions symmetrically distributed with respect to the boresight.

12. The RF antenna of claim 1, wherein the one or more protrusions comprise at least eight protrusions symmetrically distributed with respect to the boresight.

13. The RF antenna of claim 1, wherein the RF antenna is configured to exhibit a signal strength that, when compared to a reference signal strength of a perfectly isotropic antenna, differs by at most 1 dB at +/−90 degrees from the boresight, and differs by at most 9 dB at +/−150 degrees from the boresight.

14. An antenna system, comprising:

a reflector a feed, illuminating said reflector, and comprising:

a waveguide, the waveguide including:

at least one electrically conductive interior wall surface, and having a boresight defined by a longitudinal axis, the waveguide having an aperture plane transverse to the longitudinal axis and disposed at a distal end of the waveguide, the waveguide configured for one or both of radiating RF energy and receiving RF energy; and one or more electrically conductive protrusions, a first proximal portion of the protrusion electrically coupled to the electrically conductive interior wall surface, a distal portion of the protrusion being outside the aperture plane; wherein:

the waveguide is configured to exhibit a quasi-omnidirectional coverage pattern.

15. The antenna system of claim 14, wherein the one or more protrusions are configured to at least partially extend one or both of internal electromagnetic currents and internal electromagnetic fields of the feed in a direction toward the proximal end of the waveguide.

16. The antenna system of claim 14, wherein an outermost edge of the distal portion extends radially outward beyond an exterior surface of the wave guide.

17. The antenna system of claim 14, wherein at least one of the one or more protrusions includes a second proximal portion that extends axially, outside an exterior surface of the wave guide, from the distal portion toward the proximal end of the waveguide.

18. The antenna system of claim 14, wherein the waveguide includes electrically conductive ridges.

19. The antenna system of claim 14, wherein at least one of the one or more protrusions is coupled with at least one of the electrically conductive ridges.

20. The antenna system of claim 14, wherein the waveguide is configured to exhibit a signal strength that, when compared to a reference signal strength of a perfectly isotropic antenna, differs by at most 1 dB at +/−90 degrees from the boresight, and differs by at most 9 dB at +/−150 degrees from the boresight.

* * * * *